US005976000A

United States Patent [19]

Hudson

[11] Patent Number: 5,976,000

[45] Date of Patent: Nov. 2, 1999

[54] POLISHING PAD WITH INCOMPRESSIBLE, HIGHLY SOLUBLE PARTICLES FOR CHEMICAL-MECHANICAL PLANARIZATION OF SEMICONDUCTOR WAFERS

[75] Inventor: Guy F. Hudson, Boise, Id.

[73] Assignee: Micron Technology, Inc., Boise, Id.

[21] Appl. No.: 09/229,476

[22] Filed: Jan. 13, 1999

Related U.S. Application Data

[63] Continuation of application No. 08/654,337, May 28, 1996, abandoned.

[51] Int. Cl.[6] ..... B24D 17/00

[52] U.S. Cl. ..... 451/534; 451/526; 451/532; 522/90; 522/94; 524/41; 524/46; 524/423; 524/425; 524/428; 524/429

[58] Field of Search ..... 451/526, 532, 451/534; 522/90–96; 524/41, 46, 423, 425, 428, 429

[56] References Cited

U.S. PATENT DOCUMENTS

| | | | |
|---|---|---|---|
| 3,737,400 | 6/1973 | Kumasaka et al. | 521/119 |
| 4,222,926 | 9/1980 | Mizuno et al. | 524/34 |
| 4,908,161 | 3/1990 | Ashida | 252/609 |
| 5,308,438 | 5/1994 | Cote et al. | 216/86 |
| 5,401,798 | 3/1995 | Rasp et al. | 524/423 |
| 5,476,416 | 12/1995 | Kodate | 451/526 |
| 5,533,923 | 7/1996 | Shamovilian et al. | 451/41 |

*Primary Examiner*—Bernard Codd
*Attorney, Agent, or Firm*—Seed and Berry, LLP

[57] ABSTRACT

A hard polishing pad with a porous surface for use in chemical-mechanical planarization of semiconductor wafers. The polishing pad has a body with a planarizing surface upon which a slurry may be deposited, and a plurality of particles are suspended in the body. The body is made from a continuous phase matrix material, and the particles are made from a substantially incompressible material that is soluble in the slurry. As a wafer is planarized, the particles at the planarizing surface of the polishing pad dissolve in the slurry and create pores in the pad. Also, because the particles are substantially incompressible, they reinforce the pad to provide a hard, substantially incompressible pad.

12 Claims, 2 Drawing Sheets

POLISHING PAD WITH INCOMPRESSIBLE, HIGHLY SOLUBLE PARTICLES FOR CHEMICAL-MECHANICAL PLANARIZATION OF SEMICONDUCTOR WAFERS

CROSS-REFERENCE TO RELATED APPLICATION

This application is a continuation of U.S. patent application Ser. No. 08/654,337, filed May 28, 1996, now abandoned.

TECHNICAL FIELD

The present invention relates to polishing pads for chemical-mechanical planarization of semiconductor wafers; more particularly, the present invention is a polishing pad with a substantially incompressible filler material that is highly soluble in a slurry used in chemical-mechanical planarization processes.

BACKGROUND OF THE INVENTION

Chemical-mechanical planarization ("CMP") processes remove material from the surface of a wafer in the production of ultra-high density integrated circuits. In a typical CMP process, a wafer is pressed against a polishing pad in the presence of a slurry under controlled chemical, pressure, velocity, and temperature conditions. The slurry solution generally contains small, abrasive particles that abrade the surface of the wafer, and chemicals that etch and/or oxidize the surface of the wafer. The polishing pad is generally a planar pad made from a relatively soft, porous material such as polyurethane. Thus, when the pad and/or the wafer moves with respect to the other, material is removed from the surface of the wafer by the abrasive particles (mechanical removal) and by the chemicals in the slurry (chemical removal).

FIG. 1 schematically illustrates a conventional CMP machine 10 with a platen 20, a wafer carrier 30, a polishing pad 40, and a slurry 44 on the polishing pad. An under-pad 25 is typically attached to the upper surface 22 of the platen 20, and the polishing pad 40 is positioned on the under-pad 25. A drive assembly 26 rotates the platen 20 as indicated by arrow A, or in another existing CMP machine the drive assembly 26 reciprocates the platen 20 back and forth as indicated by arrow B. The motion of the platen 20 is imparted to the pad 40 through the under-pad 25 because the polishing pad 40 frictionally engages the under-pad 25. The wafer carrier 30 has a lower surface 32 to which a wafer 12 may be attached, or the wafer 12 may be attached to a resilient pad 34 positioned between the wafer 12 and the lower surface 32. The wafer carrier 30 may be a weighted, free-floating wafer carrier, or an actuator assembly 36 may be attached to the wafer carrier 30 to impart axial and rotational motion, as indicated by arrows C and D, respectively.

In the operation of the conventional planarizer 10, the wafer 12 is positioned face-downward against the polishing pad 40, and then the platen 20 and the wafer carrier 30 move relative to one another. As the face of the wafer 12 moves across the planarizing surface 42 of the polishing pad 40, the polishing pad 40 and the slurry 44 remove material from the wafer 12.

CMP processes must also consistently and accurately produce a uniform, planar surface on the wafer because it is important to accurately focus optical or electromagnetic emissions in precise circuit patterns on the surface of the wafer. As the density of integrated circuits increases, it is often necessary to focus the optical or electromagnetic emissions to within a resolution of approximately 0.35–0.5 $\mu$m. Focusing the circuit patterns to such small tolerances, however, is very difficult when the distance between the emission source and the surface of the wafer varies because the surface of the wafer is not uniformly planar. In fact, several devices may be defective on a wafer with a non-uniformly planar surface. Thus, CMP processes must create a highly uniform, planar surface.

The planarity of a polished semiconductor wafer is a function of several factors, one of which is the distribution of slurry between the polishing pad and the wafer. The polishing rate, which is the rate at which material is removed from the wafer, depends in part on the volume slurry between the wafer and the pad. To maintain a uniform polishing rate across the surface of the wafer and produce a uniformly planar surface, it is desirable to distribute the slurry evenly across the whole surface area of the wafer.

Another factor affecting the planarity of a polished wafer is the compressibility of the pad. Soft pads conform to the general topography of the wafer and result in a surface that retains some of the topographical features of the unpolished wafer. Relatively incompressible pads, on the other hand, do not readily conform to the topography of the wafer; as a result, hard pads planarize high points on the wafer before reaching low points to produce a more uniformly planar surface on the wafer. Therefore, it is generally desirable to provide a hard polishing pad that enhances the distribution of slurry between the wafer and the polishing pad.

One desirable technique to enhance the distribution of slurry under the wafer is to provide a porous structure in the polishing pad that holds additional slurry slightly below the polishing surface of the polishing pad. Conventional porous polishing pads have a body made from a continuous phase matrix material and a filler material made from hollow spheres or closed cell foam. The continuous phase matrix material is typically made from a compressible polymeric material, and the hollow spheres are typically made from polymers. When the pad is cut or conditioned, the center of the hollow spheres and porous structure of the closed cell foam form pores in the pad. The porosity of a pad is controlled by the density of the filler material in the continuous phase matrix material, with a higher density of filler material resulting in a higher porosity of the pad. Thus, it is generally desirable to use a higher density of filler material. One problem with conventional porous polishing pads is that the hollow spheres and closed cell foam are compressible and do not reinforce the continuous phase matrix material to provide a sufficiently hard polishing pad. The use of a higher density of filler material to provide high porosity accordingly results in a compressible pad that conforms to the topography of the wafer. Therefore, it is difficult to provide a polishing pad having both high porosity and substantial hardness.

Many techniques and structures have also been developed to increase the hardness of polishing pads. Typically, glass particles or fibers are added to the matrix material to reinforce the pad and increase its hardness. Glass reinforced polishing pads, however, do not have adequate porosity because glass is not readily soluble in solutions that may be used with polyurethane. Therefore, conventional polishing pads with glass particles and fibers do not distribute the slurry uniformly across the surface of the wafer.

In light of the problems associated with conventional porous and hard polishing pads, it would be desirable to develop a relatively hard polishing pad that has a sufficiently porous planarizing surface.

SUMMARY OF THE INVENTION

The inventive polishing pad is a hard polishing pad with a porous surface for use in chemical-mechanical planarization of semiconductor wafers. The polishing pad has a body with a planarizing surface upon which a slurry may be deposited, and a plurality of particles are suspended in the body. The body is made from a continuous phase matrix material, and the particles are made from a substantially incompressible material that is soluble in the slurry. As a wafer is planarized, the particles at the planarizing surface of the polishing pad dissolve in the slurry and create pores in the pad. Also, because the particles are substantially incompressible, they reinforce the pad to provide a hard, relatively incompressible pad.

The materials from which the particles are made are selected to dissolve in the particular type of slurry used in the specific CMP process. In one embodiment, which is useful with aqueous slurries, the particles may be made from organic salts or inorganic salts that dissolve in water. In another embodiment, which is useful with slurries that are used to planarize metal layers, the particles may be made from metal oxidants. The particles are preferably solid to make them substantially incompressible and thus increase the hardness of the pad.

DETAILED DESCRIPTION OF THE INVENTION

The present invention is a hard polishing pad with a flat, porous polishing surface to uniformly planarize the surface of a wafer. An important aspect of the invention is to suspend a plurality of substantially incompressible, highly soluble particles in the body. The particles reinforce the polishing pad to increase the hardness of the pad. As a result, the pad provides a more uniform, planar polishing surface that does not readily conform to the topography of the wafer. The particles also dissolve in the slurry to create pores on the planarizing surface of the polishing pad that hold additional slurry under the surface of the wafer. Importantly, the particles dissolve in situ while the wafer is being planarized to provide a continuously porous surface on the polishing pad. Therefore, the polishing pad of the present invention also enhances the distribution of slurry under the surface on the wafer. FIGS. 2–5, in which like reference numbers refer to like parts throughout the various views, illustrate a polishing pad in accordance with the invention.

Figure 1:
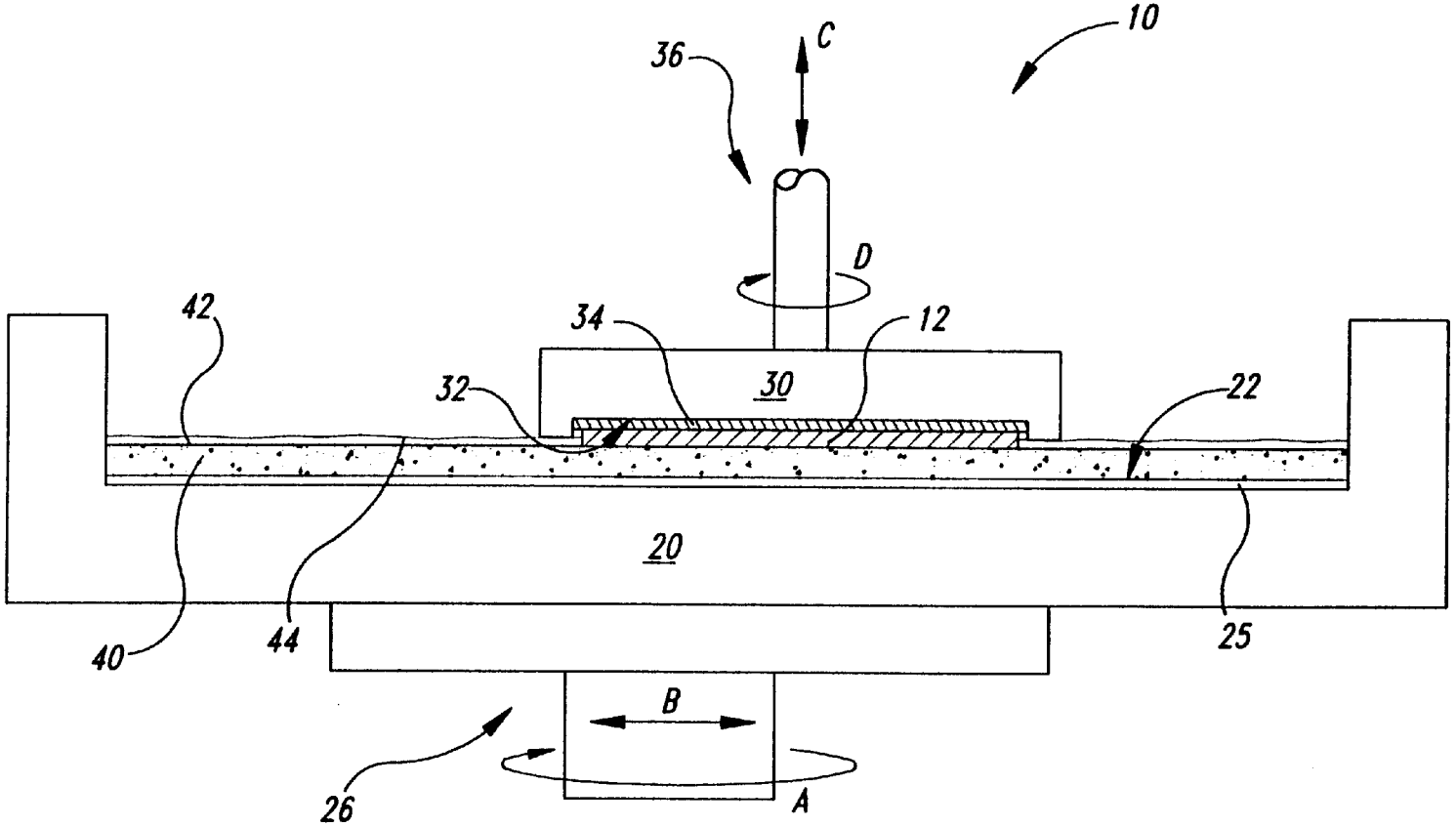
Fig. 1 (Prior Art)
FIG. 1 is a schematic cross-sectional view of a planarizing machine in accordance with the prior art.
Figure 2:
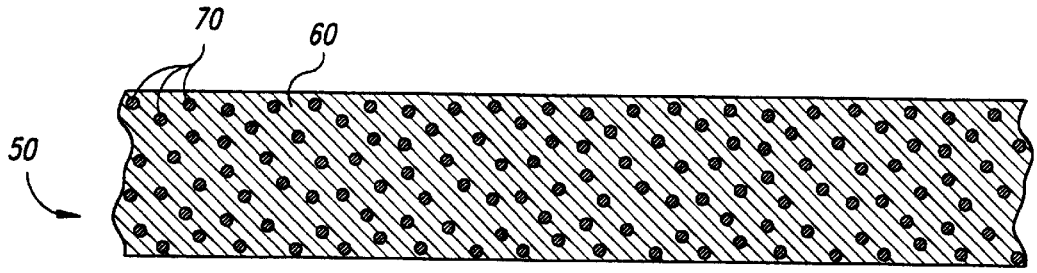
FIG. 2 is a fragmentary, schematic cross-sectional view of a polishing pad in accordance with the invention.

FIG. 2 illustrates a polishing pad 50 that has a body 60 and a plurality of particles 70 suspended in the body 60. The polishing pad 50 may be used on the CMP machine 10 described above with respect to FIG. 1. The body 60 is made from a continuous phase matrix material that is preferably an elastomeric material or polymeric material. One suitable matrix material is polyurethane. The suspended particles 70 are made from a hard, substantially incompressible material that is readily soluble in a chemical-mechanical planarization slurry. The particles 70 preferably do not have any internal voids so that they are substantially solid in cross-section to further enhance the hardness of the particles. Because different slurries are used in different CMP applications, the suspended particles 70 are made from materials that are selected to dissolve in the particular slurry that is to be used in a particular CMP application. In the case of aqueous slurries, the particles 70 are preferably made from cellulosic materials, inorganic salts, or organic salts. Suitable cellulosic materials include, but are not limited to, cellulose acetate and methylethyl cellulose. Similarly, suitable inorganic salts include, but are not limited to, ammonium salts such as ammonium carbonate, ammonium chloride, ammonium nitrate, and ammonium sulfate. In other slurries that are used to planarize metal layers, the particles may be made from metal oxidants such as ferric nitrate and potassium iodate.

In addition to selecting the appropriate materials for making the particles 70, the particle size and the density of the particles are controlled to vary the hardness and the porosity of the pad. In general, large particle sizes and high densities of particles increase the porosity of the pad and enhance the distribution of slurry under the wafer. However, as the particles dissolve, the porous areas soften the pad which reduces the planarity of the polishing surface. The size of the particles 70 is preferably between approximately 0.1 and approximately 3 $\mu$m in diameter, and more preferably between 0.5 and 1.5 $\mu$m. The density of the particles 70 with respect to the matrix material of the body 60 is preferably between approximately 10% and approximately 50% of the pad 50 by volume, and more preferably between 20% and 30%.

Figure 3:
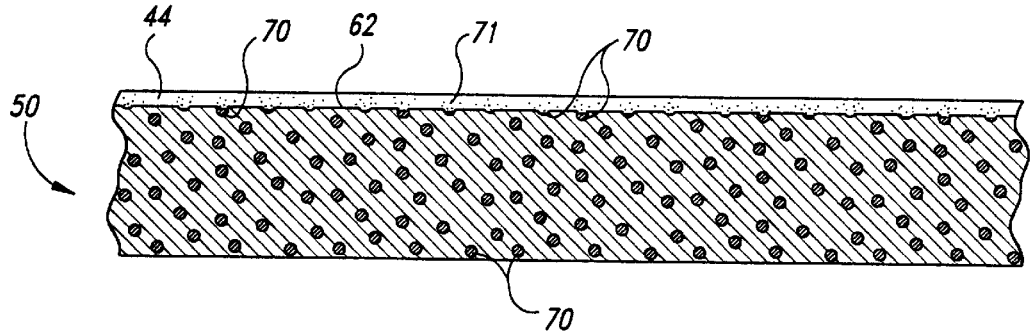
FIG. 3 is a fragmentary, schematic cross-sectional view of the polishing pad of FIG. 2 with a slurry thereon.
Figure 4:
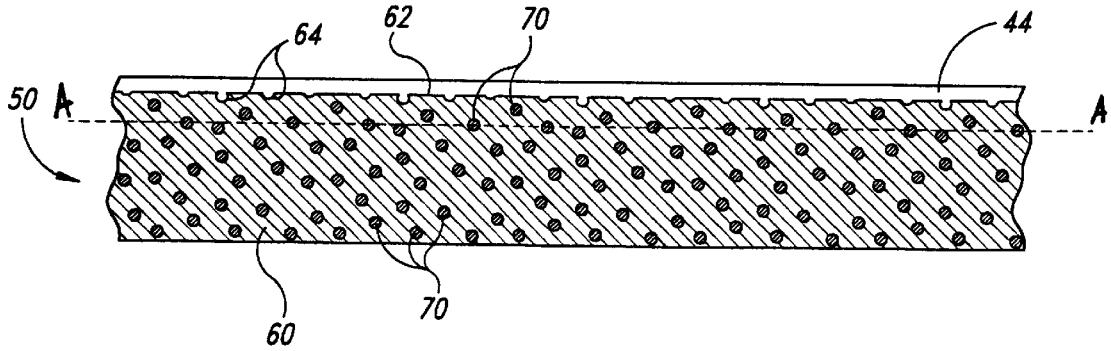
FIG. 4 is a fragmentary, schematic cross-sectional view of the polishing pad of FIG. 3.

FIGS. 3 and 4 illustrate the operation of the polishing pad 50. Referring to FIG. 3, a slurry 44 is deposited on top of the polishing surface 62 of the polishing pad 50. The slurry 44 dissolves the particles 70 at the polishing surface 62 that are exposed to the slurry 44. As the particles 70 dissolve in the slurry 44, the particles 70 break down into molecules or groups of molecules 71 that are carried away in the slurry 44. Referring to FIG. 4, a number of pores 64 are formed in the polishing surface 62 of the polishing pad 50 in the areas vacated by the particles 70. The slurry 44 fills the pores so that additional slurry is stored just under the top of the polishing surface 62 to provide slurry across the whole face of the wafer (not shown) as the wafer moves over the pad.

During the CMP process, waste materials from the wafer and the pad accumulate on the planarizing surface 62 of the polishing pad 50 and fill the pores 64. As a result, the polishing pad 50 must be periodically conditioned by removing material from the planarizing surface 62 to expose a new planarizing surface at an intermediate depth in the pad 50 (shown by line A—A in FIG. 4). Each time the pad 50 is conditioned, a new set of particles 70 is exposed at the new planarizing surface. When a newly conditioned pad is used to planarize a wafer, the newly exposed particles 70 dissolve in the pressure of the slurry to form new pores on the surface of the pad. The polishing pad 50 accordingly has a continuously porous surface to consistently enhance the distribution of slurry under the wafer.

The polishing pad 50 is made by mixing the particles 70 with the continuous phase matrix material while the matrix material is in a flowable state. The mixture of particles 70 and matrix material is then cast by pouring the mixture in a mold or by injecting the mixture in a mold using an injection molding process. After the mixture is cast, the continuous phase material is cured to form a solid body in which the particles a suspended. In a preferred embodiment, a surfactant is either added to the continuous phase matrix material while it is in a flowable state or deposited on the particles. The surfactant inhibits the particles from agglomerating to enhance the uniformity of the distribution of the particles in the body. Those skilled in the art will understand that numerous variations of the process of making the pad 50 can be employed to make the pad. Accordingly, the casting processes, cure rates, surfactants, temperatures and cutting processes are well known in the art.

One advantage of the present invention is that the polishing pad 50 is a hard, substantially incompressible pad that produces a more uniformly planar surface on the polished wafer. Unlike conventional hollow sphere and closed cell foam polishing pads, the substantially incompressible particles of the present invention do not compress under typical down forces in chemical-mechanical planarization processes. The polishing pad 50 of the present invention, therefore, only compresses to the extent of the polyurethane in the interstitial spaces between the particles 70. Thus, the substantially incompressible particles 70 of the polishing pad 50 increase the hardness of the pad 50 to provide a more uniformly planar polishing surface on the polishing pad.

Another advantage of the present invention is that the polishing surface of the polishing pad has a consistently porous structure that enhances the distribution of slurry under the surface of the wafer. The structure is consistently porous because the particles are readily soluble in the slurry in situ while the wafer is planarized. Therefore, the polishing pad of the present invention automatically provides a porous surface to enhance the distribution of slurry under the wafer.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A chemical-mechanical planarization polishing pad for planarizing a semiconductor wafer, comprising:

a body having a first section and a second section over the first section, the second section having a polishing surface with at least one planar portion configured to chemically-mechanically planarize the semiconductor wafer, the body being made from a continuous phase matrix material; and a plurality of incompressible particles suspended in the first and the second sections of the body to inhibit compression of the body by reinforcing the continuous phase matrix material, the first section of the body with the incompressible particles being hard and substantially incompressible to provide a planar polishing surface on the second section that does not readily conform to the topography of the wafer, at least a portion of the particles being exposed at the polishing surface and the exposed particles at the polishing surface being at least partially removed to define pores at the polishing surface of the pad extending only in the second section of the body.

2. The pad of claim 1 wherein the matrix material is made from polyurethane and the particles are made from an inorganic salt.

3. The pad of claim 1 wherein the matrix material is made from polyurethane and the particles are made from a metal oxidant.

4. The pad of claim 3 wherein the metal oxidant is a material selected from the group consisting of ferric nitrate and potassium iodate.

5. The pad of claim 1 wherein the particles are solid.

6. The pad of claim 1 wherein the particles occupy approximately 10% to 50% of the pad by volume.

7. The pad of claim 1 wherein the particles are selected from a material that is soluble in a planarizing slurry, the pores being formed by dissolving the exposed particles at the surface in the slurry.

8. A chemical-mechanical planarization polishing pad for planarizing a semiconductor wafer, comprising:

a body having a first section and a second section over the first section, the second section having a polishing surface with at least one planar portion configured to chemically-mechanically planarize the semiconductor wafer, the body being made from a continuous phase matrix material comprising polyurethane; and a plurality of incompressible particles suspended in the first and the second sections of the body to inhibit compression of the body by reinforcing the continuous phase matrix material, wherein the particles comprise an ammonium salt, and at least a portion of the particles being exposed at the polishing surface and the exposed particles at the polishing surface being at least partially removed to define pores at the polishing surface of the pad extending only in the second section of the body.

9. The pad of claim 8 wherein the ammonium salt is selected from the group consisting of ammonium carbonate, ammonium chloride, ammonium nitrate, and ammonium sulfate.

10. A chemical-mechanical planarization polishing pad for planarizing a semiconductor wafer, comprising:

a body having a first section and a second section over the first section, the second section having a polishing surface with at least one planar portion configured to chemically-mechanically planarize the semiconductor wafer, the body being made from a continuous phase matrix material; and a plurality of incompressible particles suspended in the first and the second sections of the body to inhibit compression of the body by reinforcing the continuous phase matrix material, wherein the particles are made from a cellulosic material, at least a portion of the particles being exposed at the polishing surface and the exposed particles at the polishing surface being at least partially removed to define pores at the polishing surface of the pad extending only in the second section of the body.

11. The polishing pad of claim 10 wherein the cellulosic material is a material selected from the group consisting of cellulose acetate and methylethyl cellulose.

12. A chemical-mechanical planarization polishing pad for planarizing a semiconductor wafer, comprising:

a body having a first section and a second section over the first section, the second section having a polishing surface with at least one planar portion configured to chemically-mechanically planarize the semiconductor wafer, the body being made from a continuous phase matrix material; and a plurality of incompressible particles suspended in the first and the second sections of the body to inhibit compression of the body by reinforcing the continuous phase matrix material, wherein the particles have an average diameter of approximately 0.1 to 3 $\mu$m, and at least a portion of the particles being exposed at the polishing surface and the exposed particles at the polishing surface being at least partially removed to define pores at the polishing surface of the pad extending only in the second section of the body.

* * * * *